United States Patent [19]

Meredith et al.

[11] Patent Number: 5,018,735

[45] Date of Patent: May 28, 1991

[54] LOW KICK POINT GOLF CLUB SHAFT

[75] Inventors: Steven E. Meredith; James F. Benjamin, both of Kennewick, Wash.

[73] Assignee: Sandvik Special Metals Corporation, Kennewick, Wash.

[21] Appl. No.: 433,855

[22] Filed: Nov. 9, 1989

[51] Int. Cl.[5] ..... A63B 53/12

[52] U.S. Cl. ..... 273/80 B

[58] Field of Search ..... 273/80 R, 80 B, 77 A, 273/77 R, 80 A

[56] References Cited

U.S. PATENT DOCUMENTS

| | | | |
|---|---|---|---|
| Re. 19,731 | 10/1935 | Hackett | 273/80 B |
| 976,267 | 11/1910 | Knight | 273/80 B |
| 1,662,712 | 3/1928 | Mensing | 273/80 B |
| 1,670,531 | 5/1928 | Cowdery | 273/80 B |
| 1,974,389 | 9/1934 | Cowdery | 273/80 B |
| 2,037,636 | 4/1936 | Lagerblade | 273/80 B |
| 2,050,554 | 8/1936 | Barnhart | 273/80 B |
| 2,066,962 | 1/1937 | Cross | 273/80 R |
| 2,124,534 | 7/1938 | Barnhart | 273/80 B |
| 2,153,550 | 4/1939 | Cowdery | 273/80 R |
| 2,250,428 | 7/1941 | Vickery | 273/80 B |
| 2,457,177 | 12/1948 | Reach | 273/80 R |
| 2,934,345 | 4/1960 | Scott | 273/80 B |
| 3,083,969 | 4/1963 | Bills, Jr. | 273/80 R |
| 3,519,270 | 7/1970 | Baymiller | 273/80 B |
| 3,809,403 | 5/1974 | Hunter | 273/80 B |
| 4,123,055 | 10/1978 | Brill | 273/77 A |
| 4,125,260 | 11/1978 | Kanne et al. | 273/80 R |
| 4,165,874 | 8/1979 | Lezatte etal. | 273/77 A |
| 4,169,595 | 10/1979 | Kaugars | 273/80 R |
| 4,319,750 | 3/1982 | Roy | 273/80 B |
| 4,558,863 | 12/1985 | Haas et al. | 273/77 A |
| 4,563,007 | 1/1986 | Bayliss et al. | 273/77 A |

FOREIGN PATENT DOCUMENTS

| | | | |
|---|---|---|---|
| 465415 | 5/1937 | United Kingdom | 273/80 B |
| 2053004 | 2/1981 | United Kingdom | 273/80 B |
| 2122502 | 1/1984 | United Kingdom | 273/80 B |

OTHER PUBLICATIONS

"The Sporting Goods Dealer" magazine, Jun. 1971 issue, pp. 68, 70.

*Primary Examiner*—Edward M. Coven
*Assistant Examiner*—Sebastiano Passaniti
*Attorney, Agent, or Firm*—Burns, Doane, Swecker & Mathis

[57] ABSTRACT

A wood golf club shaft adapted to receive a wood club head is about 44 to 45 in. total length from a butt end to a tip end thereof. The shaft comprises a butt section, a tip section, and a tapered section interconnecting the butt and tip sections. The tapered section tapers down toward the tip section at a rate of 0.021 in./in. The tapered section has a length shorter than a length of the butt section, longer than a length of the tip section, and no longer than about 13 in. The shaft has a low kick point disposed at a distance of at least about 29 inches from the butt end.

12 Claims, 3 Drawing Sheets

LOW KICK POINT GOLF CLUB SHAFT

BACKGROUND OF THE INVENTION

The present invention relates to wood golf club shafts, i.e., shafts which are adapted to receive a wood club head, and especially to a wood golf club shaft exhibiting a low kick point.

A common characteristic of golf club shafts, especially wood golf club shafts, in the process of being played is a tendency for the shaft to flex or bend backwardly during the downstroke. Consequently, the amount of momentum and directional control imparted to the ball is enhanced. Accordingly, many golf club shafts have been designed to promote such a flexing action.

The point along the shaft about which a maximum flexing occurs has various names, such as "kick point", "flex point" and "whip point" for example. Shafts have been designed with a so-called high kick point located nearer to the butt of the shaft, a low kick point located nearer to the tip, and a middle kick point located at or near the shaft midpoint.

The location of the kick point along the shaft influences shaft playability by affecting the angle of the shaft at the moment of contact with the ball. That is, the lower the location of the kick point, the greater the angle of trajectory of the ball, i.e., the higher the ball travels. Thus, golfers who might otherwise tend to hit the ball too low can benefit from a low kick point shaft. Shafts with high and low kick points are depicted schematically and somewhat exaggeratedly in FIGS. 8 and 9, respectively, to contrast the high and low angles.

A shaft also exhibits a certain "feel" to a golfer which is a function of the overall flexibility of the shaft. Flexibility of the shaft can be determined by measuring a static flex characteristic of the shaft.

One conventional wood club shaft B produced by the present assignee is depicted in FIG. 7. That shaft is formed of metal such as titanium and includes a gradually tapered section 1 which interconnects butt and tip sections 2, 3 of the shaft. The butt section has a standard outer diameter d1 of 0.6 in., and the tip section has a standard outer diameter d2 of 0.335 in. The total shaft length L' is a standard 45 in. The tapered section 1 tapers down from the butt section 2 to the tip section 3 at a rate of 0.011 in./in. (i.e., the outer diameter changes by 0.011 in. per in. of length). The tapered section has a length L1' of 24.5 in., and the section of the shaft wall forming the taper gradually increases toward the tip section from a minimum thickness t1 of 0.018 in. to a maximum thickness t2 of 0.03 in. The tapered section is formed by two successive swaging operations.

In one embodiment of that shaft B the butt section length L2' is 15.5 in. and the tip section length L3' is 5 in. The static flex of the shaft is 5.94 in. The kick point of the shaft is located at a distance L4' of 28.75 in. from the butt end of the shaft. (The manner of measuring the flexure and the location of the kick point will be described hereinafter.)

In a stiffer version of the shaft B of FIG. 7, the butt section length L2' is 16.125 in. and the tip section length L3' is 4.375 in. The kick point of the shaft is located a distance L4' of 28.0 in. from the butt end of the shaft. The static flex of that shaft is 5.6 in. reflecting a greater stiffness than the earlier described embodiment.

It may be desired to change the location of a kick point of a wood club shaft in order to appeal to golfers whose style of play would benefit from such a change. This can be achieved by changing the relative strength of the butt and tip sections 2, 3 of the shaft. For example, in order to lower the kick point of a shaft, the tip section of the shaft would be weakened relative to the butt section, or the butt section would be strengthened relative to the tip section. Among the techniques which have been proposed for U.S. Pat. Nos. 2,250,428 and 4,123,055. The former patent explains how a kick point or whip point can be established by creating a step in the shaft, i.e., by reducing the diameter of the shaft at a suitable location. This reduced diameter portion lies between upper and lower shaft portions of greater diameter. Such a shaft structure is difficult to manufacture and is prone to breakage at the reduced diameter portion which serves to weaken the shaft. Furthermore, the static flex characteristic of the shaft is changed so that the club no longer has the same "feel" to the golfer.

The technique disclosed in afore-mentioned U.S. Pat. No. 4,123,055 involves the provision of a short and very steep taper, e.g., 25° to 45°, at a location spaced 5 to 10 in. from the lowermost end of the shaft. Such a steep taper may also tend to unduly weaken the shaft as well as to change the feel of the shaft.

It would be desirable, therefore, to be able to change the location of the kick point of a wood golf club shaft without materially weakening the shaft or changing the static flex characteristic of the shaft, whereby the shaft would exhibit the same feel to a golfer who is accustomed to that shaft.

SUMMARY OF THE INVENTION

The present invention relates to a low kick point wood golf club shaft adapted to receive a wood head. The shaft is about 44 to 45 in. in total length from a butt end to a tip end thereof and comprises a butt section, a tip section, and a tapered section interconnecting the butt and tip sections. The butt section has an outer diameter of about 0.6 in., the tip having an outer diameter of about 0.335 in. The tapered section tapers down toward the tip section at a rate in the range of about 0.018 to 0.025 in./in. The tapered section has a length which is shorter than a length of the butt section, longer than a length of the tip section, and no longer than about 13 in. The shaft kick point is disposed at a distance of at least about 29 in. from the butt end.

Preferably, the tapered section length is in a range of about 11.5 to 13.5 in., most preferably about 12.75 in. The taper rate of the tapered section is most preferably about 0.021 in./in.

BRIEF DESCRIPTION OF THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
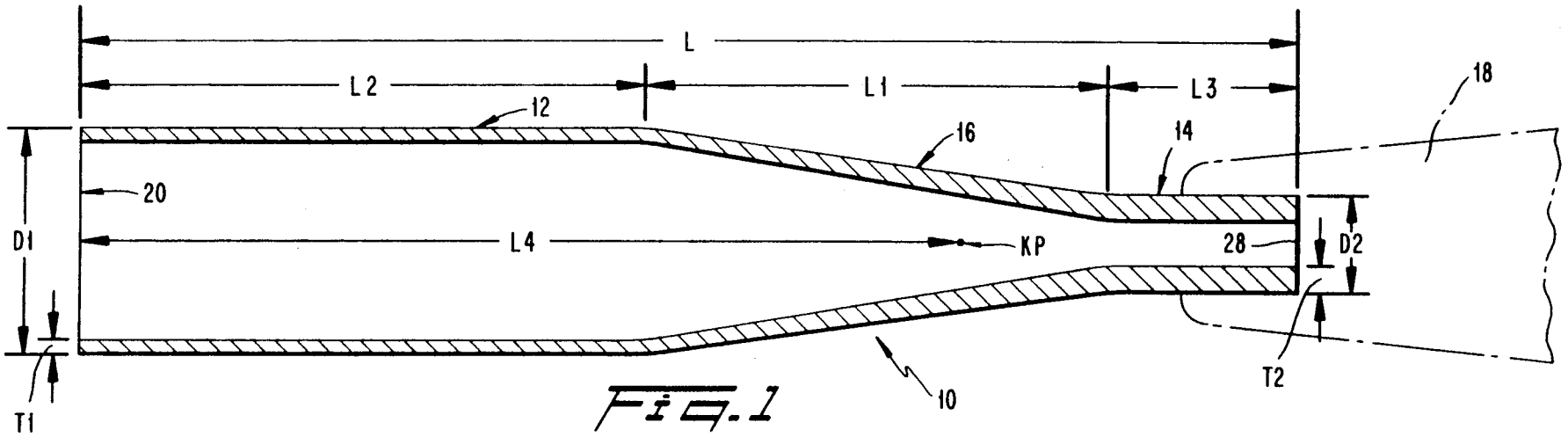
FIG. 1 is a schematic longitudinal sectional view taken through a wood golf club shaft according to the present invention.

A wood golf club shaft 10 according to the present invention (see FIG. 1) is formed of metal, such as titanium, and comprises butt and tip sections 12, 14 interconnected by a gradually tapered section 16. The butt portion 12 is cylindrical and adapted to receive a conventional grip. The tip section 14 is also cylindrical and adapted to receive a wood club head 18 shown in phantom. The overall length L of the shaft is 45 in. The butt section has an outer diameter D1 of 0.6 in., and the tip section has an outer diameter D2 of 0.335 in. The wall thickness T1 of the butt section 12 is 0.017–0.018 in. and the wall thickness T2 of the tip section 14 is 0.029–0.030 in.

The tapered section 16 has a length L1 which is appreciably shorter than the butt section length L2 and appreciably longer than the tip section length L3. The tapered section length L1 is not longer than 13 in. and is preferably in a range of about 12.5 to 13 in. The butt section length L2 is preferably in a range of about 21 to 23 in., more preferably in a range of about 22 to 22.75 in. The tip section length is preferably in a range of about 9 to 11 in. and more preferably about 9.25 to 10.25 in.

The tapered section 16 tapers down toward the tip section at a rate in a range of about 0.018 to 0.025 in./in., preferably about 0.020 to 0.023 in./in., and most preferably about 0.021 in./in. The kick point KP of the shaft is located at a distance L4 of at least about 29 in. from the butt end 20 of the shaft.

Figure 3:
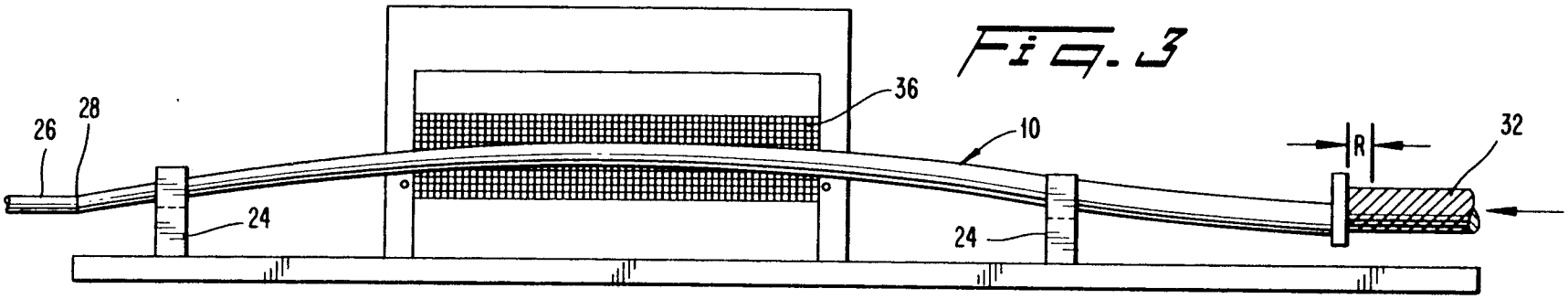
FIG. 3 is a view similar to FIG. 2 after a test shaft has been buckled.
Figure 4:
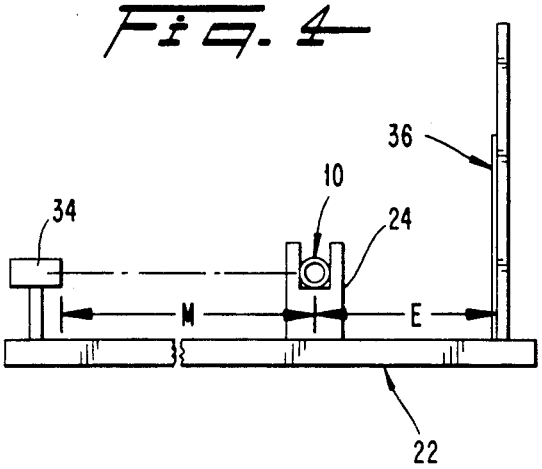
FIG. 4 is a side elevational view of the test fixture depicted in FIG. 2.

The kick point location of the shaft is measured by the following procedure. The shaft 10 is placed in a test fixture 22 (FIGS. 2–4) which includes a pair of yoke-shaped support guides 24. Those guides permit the shaft to move in only a vertical direction. A steel mandrel 26 abuts against the tip end 28 of the shaft and is held stationary in any suitable manner. The butt end 20 of the shaft rests against a plate 30 which is attached to a movable rod 32 which may, for example, comprise a threaded rod arranged in a turnbuckle (not shown) which enables the rod to be displaced toward the shaft 10. By displacing the rod 32 toward the shaft, the butt end of the shaft 10 will be displaced, causing the shaft to buckle as depicted in FIG. 3. The rod is displaced by a distance R of 0.75 in.

Figure 2:
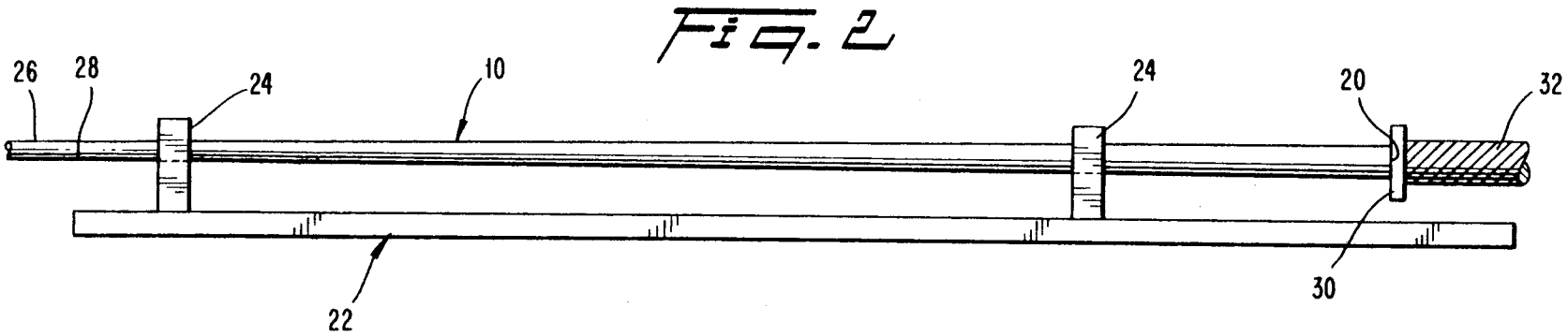
FIG. 2 is a front elevational view of a test fixture according to the present invention prior to buckling of a test shaft.
Figure 5:
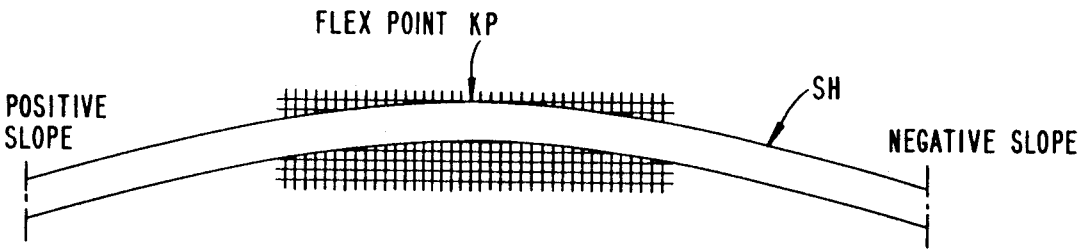
FIG. 5 is a fragmentary view of a shadow cast by a buckled shaft during a measurement of the flex point of the shaft.

A 150 watt spotlight 34 (FIG. 4) is disposed at a distance M of 51 inches from the shaft axis at the same elevation as the shaft axis when the shaft is in a non-buckled state (FIG. 2). The light 34 is actuated to cause the shaft 10 to cast a shadow SH onto a sheet of grid paper 36 situated at a distance E′ of three inches from the shaft axis. The kick point KP is taken as the point on the grid paper representing the maximum deflection of the shaft, i.e., the highest point of the shadow on the grid paper (see FIG. 5). That point occurs where the slope of the shaft becomes positive. The presence of the grid paper makes it easier to measure the distance to the kick point from the butt end of the shaft. Thus, the use of grid paper is not absolutely necessary, but rather is used to facilitate measurements.

Figure 6:
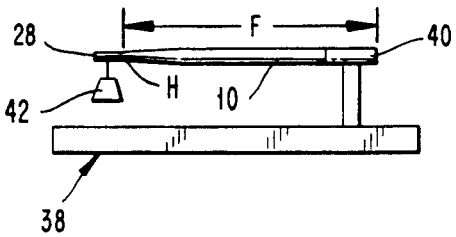
FIG. 6 is a front elevational view of a test fixture for determining the static flex of a shaft.
Figure 8:
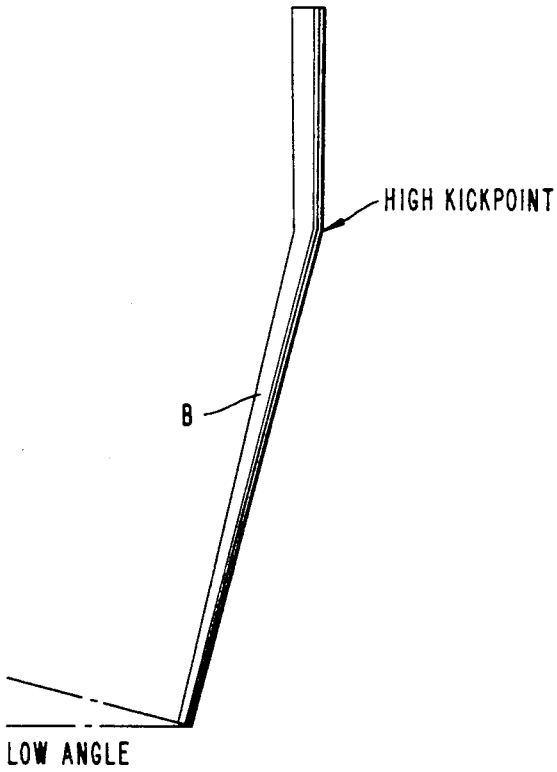
Fig. 8 (PRIOR ART)
FIGS. 8 and 9 are schematic side elevational views of a wood golf club shaft representing the manner of shaft deflection associated with a high kick point and a low kick point, respectively.
Figure 9:
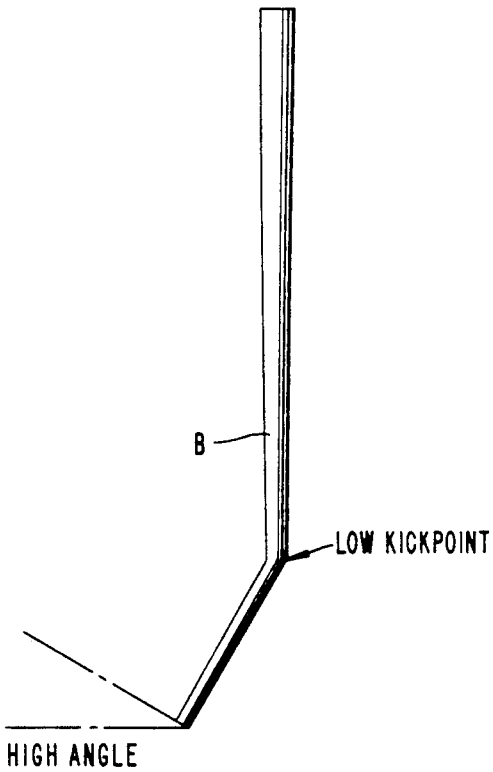
Fig. 9 (PRIOR ART)

The static flex of the shaft 10 is measured in a separate fixture 38 (see FIG. 6) in which the butt section of the shaft is clamped by a clamp 40 over the end-most 5.75 in. of the length of the butt section. A weight 42 of 6.25 lbs. is hung from the tip section of the shaft at a distance of 0.625 in. from the tip end 28. This causes the shaft to bend. A spotlight spaced 76 in. from the shaft in a direction perpendicular to the paper is then turned on to cause the bent shaft to cast a shadow onto grid paper (not shown) located at 2 in. behind the shaft, in a manner similar to that described earlier in connection with the fixture 22. The spotlight is disposed at the same elevation as the shaft axis before the shaft is bent. The vertical deflection of a point H on the shaft spaced a distance F of 40.5 in. from the butt end is then measured as the static flex of the shaft. That particular point on the shaft represents the point where the end of the club head hosel will be located.

Figure 7:
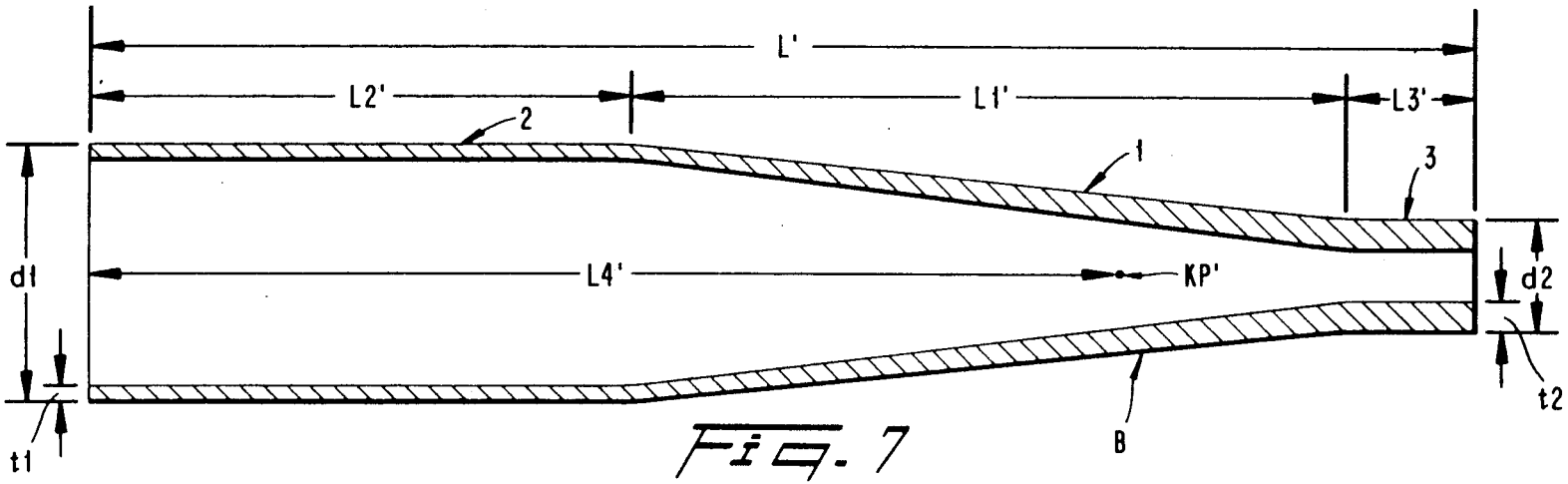
Fig. 7 (PRIOR ART)
FIG. 7 is a schematic longitudinal sectional view taken through a prior art wood golf club shaft.

In a first example of the shaft 10 according to the present invention, L=45 in.; D1=0.6 in.; D2=0.335 in.; L1=12.75 in.; L2=22 in.; L3=10.25 in.; T1=0.017 in.; and T2=0.029 in. The tapered section 16 tapers at a rate of 0.021 in./in. The kick point KP is located at a distance L4′ of 29.75 in. from the butt end 20 of the shaft. The static flex G of the shaft is 5.94 in. That shaft has a somewhat lower kick point than the previously described first version of the conventional shaft B described in connection with FIG. 7 (i.e., 29.75 in. versus 28.75 in.), but has the same static flex of 5.94 in. Thus, the shaft 10 exhibits the same feel to the user, while imparting a higher elevation to the ball.

In a second, somewhat stiffer version of the shaft 10 according to the present invention, L=45 in.; D1=0.6 in.; D2=0.335 in.; L1=12.75 in.; L2=22.75 in.; and L3=9.5 in.; T1=0.018 in.; and T2=0.03 in. The kick point is located 29 in. from the butt end, and the static flex is 5.6 in. This shaft thus has a somewhat lower kick point than the previously described second version of the conventional shaft according to FIG. 7 (i.e., 29 in. versus 28 in.), but has the same static flex of 5.6 in. Therefore, this stiffer version of the shaft 10 exhibits the same feel, while imparting a higher elevation to the ball.

From the foregoing, it will be appreciated that the length and gradual rate of taper of the tapering section according to the present invention enables the kick point of a wood golf club shaft to be changed while enabling the same feel of the shaft to be more easily maintained. Also, the tapering section length is in a range which can be easily produced by a single swaging operation.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A low kick point wood golf club shaft adapted to receive a wood club head, said shaft being about 44 to 45 in. in total length from a butt end to a tip end thereof and comprising a generally cylindrical butt section, a generally cylindrical tip section, and a tapered section interconnecting said butt and tip sections, said butt section having an outer diameter of about 0.6 in. at the junction with said tapered section, said tip section having an outer diameter of about 0.335 in. at the junction with said tapered section, said tapered section having a smoothly tapering outer diameter tapering down from said butt section to said tip section at a rate in a range of about 0.018 to 0.025 in./in., said tapered section having a length shorter than a length of said butt section, longer than a length of said tip section, and no longer than about 13 in., said shaft having a kick point disposed at a distance of at least about 29 in. from said butt end.

2. A shaft according to claim 1, wherein said shaft total length is 45 in. and said taper rate of said tapered section being about 0.021 in./in.

3. A shaft according to claim 2, wherein said kick point is disposed at a distance of about 29.75 in. from said butt end.

4. A shaft according to claim 3, wherein said butt section length is in a range of about 21 to 23 in., said tip section length is in a range of about 9 to 11 in., and said tapered section length is in a range of about 11.5 to 13.5 in.

5. A shaft according to claim 3, wherein said butt section length is about 22 in., said tip section is about 12.75 in.

6. A shaft according to claim 3, wherein said butt section length is about 22.75 in., said tip section length is about 9.5 in., and said tapered section length is about 12.75 in.

7. A shaft according to claim 1, wherein said shaft is formed of metal.

8. A low kick point wood golf club shaft adapted to receive a wood club head, said shaft being about 44 to 45 inches in total length from a butt end to a tip end thereof, and comprising:

a generally cylindrical butt section having an outer diameter of about 0.6 inches, and a length in a range of about 21 to 23 inches, a generally cylindrical tip section for receiving the wood club head and having an outer diameter of about 0.335 inches and a length in a range of about 9 to 11 inches, and a tapered section interconnecting said butt and tip sections and having a smoothly tapering outer diameter tapering down from said butt section to said tip section at a rate in a range of about 0.018 to 0.025 in./in., said tapered section having a length which is shorter than said butt section and longer than said tip section, said length being in a range of about 11.5 to 13.5 in., said shaft having a kick point spaced from said butt end by a distance in a range of about 29 to 29.75 inches.

9. A shaft according to claim 8, wherein said butt section length is in a range of about 22 to 22.75 in., said tip section length is in a range of about 9.25 to 10.25 in., said tapered section length in a range of about 12.75 to 13 in., said taper rate is in a range of about 0.02 to 0.023 in./in., and said kick point distance from said butt end is in a range of about 29 to 29.75 in.

10. A shaft according to claim 9, wherein said butt section length is about 22 in., said tip section length is about 10.25 in., said tapered section length is about 12.75 in., said taper rate is about 0.021 in./in., and said kick point distance from said butt end is about 29.75 in.

11. A shaft according to claim 9, wherein said butt section length is about 22.75 in., said tip section length is about 9.5 in., said tapered section length is about 12.75 in., said taper rate is about 0.021 in./in., and said kick point distance from said butt end is about 29 in.

12. A shaft according to claim 1, wherein said shaft is formed of metal.

* * * * *